United States Patent [19]

Larkin et al.

[11] 4,250,369

[45] Feb. 10, 1981

[54] FORMED PIVOT FOR TOGGLE LEVER AND METHOD OF MAKING

[75] Inventors: Robert E. Larkin, Sussex; Earl T. Piber, Oconomowoc, both of Wis.

[73] Assignee: Eaton Corporation, Cleveland, Ohio

[21] Appl. No.: 20,823

[22] Filed: Mar. 15, 1979

[51] Int. Cl.[3] ..... H01H 3/04

[52] U.S. Cl. ..... 200/339; 200/315

[58] Field of Search ..... H01H/9/00; 200/339, 200/332, 335, 315, 153 G, 153 H

[56] References Cited

U.S. PATENT DOCUMENTS

| | | | |
|---|---|---|---|
| 2,355,781 | 8/1944 | Cardinal | 29/143 |
| 2,434,065 | 1/1948 | Courtney | 200/315 |
| 3,237,460 | 3/1966 | Morse | 200/339 X |
| 3,350,521 | 10/1967 | Brown | 200/67 |
| 3,434,195 | 3/1969 | Ritsema | 29/437 |
| 3,434,196 | 3/1969 | Lavengood | 29/437 |
| 3,581,033 | 5/1971 | Plumb | 200/339 X |
| 4,162,386 | 7/1979 | Bourgeois et al. | 200/339 |

*Primary Examiner*—Steven M. Pollard

*Attorney, Agent, or Firm*—Hugh R. Rather; William A. Autio

[57] ABSTRACT

A formed pivot structure for a pivotally operable lever mounted in a bushing such as a toggle switch lever bushing. The pivot is provided by a suitable through-hole, opposite blind holes or circular groove in the enlarged portion of the lever into which thin portions of the bushing, either perforated or unperforated, are punched from opposite sides of the bushing. This provides a pair of aligned pivots affording free pivoting of the toggle lever in one plane while retaining it snugly from wobbling out of said plane. The pivot is formed by the method of forming opposite thin sections in the bushing, forming notches in the toggle lever such as the through-hole, opposite blind holes counter-sunk if desired, or circular beveled groove in the enlarged, partial-spherical portion of the toggle lever, inserting the toggle lever within the bushing and retaining it therein in position while two punches are actuated to form the thin sections of the bushing into the corresponding notches in the toggle lever for a close fit while allowing free pivoting of the toggle lever in one plane.

16 Claims, 7 Drawing Figures

FORMED PIVOT FOR TOGGLE LEVER AND METHOD OF MAKING

BACKGROUND OF THE INVENTION

Pivot structures allowing single-plane pivotal operation of toggle levers in switch bushings have been known heretofore. A widely used pivot structure has been a pivot pin or rivet extending through the bushing and the enlarged portion of the toggle lever. Another pivot has been attained by providing a socket in a plastic bushing and an annular entry lip above the socket small enough and with sufficient resiliency to allow snap-in assembly of the partial-spherical enlarged portion of the toggle lever into such socket. Still another pivot has been attained by a two-piece bushing having a socket affording free entry of the enlarged portion of the lever from the top plus a retainer attachable to the top of the bushing to retain the toggle lever in place. A further pivot has been attained by a socket in the bushing allowing free entry of the enlarged portion of the lever from below, and relying on the spring-biased plunger or plungers at the lower end of the toggle lever for retaining the toggle lever in its socket seat.

While these prior pivots have been useful for their intended purposes, this invention relates to improvements thereover.

SUMMARY OF THE INVENTION

An object of the invention is to provide an improved pivot structure for mounting a pivotal lever in a retaining member.

A more specific object of the invention is to provide a pivot structure that confines pivotal motion to a single plane and is easy to make and more economical.

Another specific object of the invention is to provide a simple and economical pivot structure that is partly formed in situ for mounting a toggle lever in a bushing.

A further specific object of the invention is to provide a pivot structure for the toggle lever of a small electric switch that simplifies and reduces the cost of mounting the toggle lever in the switch bushing.

Other objects and advantages of the invention will hereinafter appear.

DESCRIPTION OF THE PREFERRED EMBODIMENT

Figure 1:
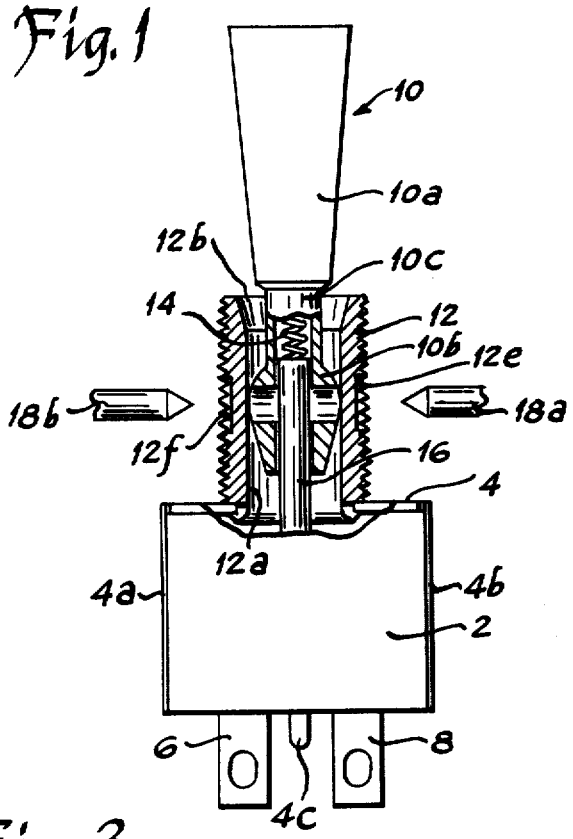
FIG. 1 is an enlarged, partial cross-sectional view of a toggle lever switch showing the pivot structure and the punches before the forming operation with respect to a first version of pivot structure.

Referring to FIG. 1, there is shown a first version of a miniature toggle switch constructed in accordance with the best mode of the invention. As shown therein, this switch is provided with a housing comprising an insulating molded plastic open-top base 2 closed by a metal frame 4. This frame is secured to the base by a pair of flaps 4*a* and 4*b* that extend down along opposite recessed sides of the base and having pairs of tabs that are bent inwardly into notches at the bottom of the base. A plurality of stationary contacts may be molded in the bottom of the base so that terminals 6 and 8 integral therewith extend out through the bottom of the base as shown in FIG. 1. The switch illustrated is a double-pole double-throw type having two rows of terminals 6 and 8 with three terminals, and corresponding stationary contacts, in each row. The contact-terminals in each pole of this switch may be generally similar to those shown in H. W. Brown U.S. Pat. No. 3,350,521, dated Oct. 31, 1967. A rib 4*c* molded integrally with the base serves to lengthen the electrical creepage paths between corresponding terminals of the two rows thereof.

Figure 6:
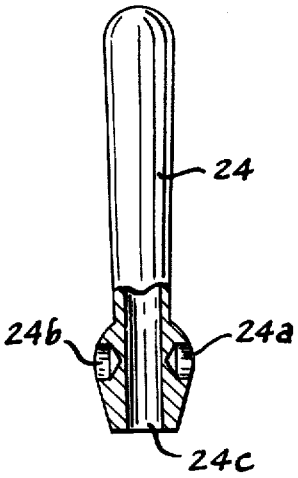
FIG. 6 is an enlarged partial cross-sectional view of a toggle lever showing a third version of pivot structure usable with the bushing of FIG. 1 or FIG. 3.

This switch is provided with means for supporting the actuator which in the illustrated embodiment is a toggle lever 10 having a desired shape such as the "paddle" shape shown in FIG. 1 or the "bat" handle shape shown in FIG. 6, or the like. This means comprises an exteriorly threaded bushing 12 secured at its lower end to the rim of a hole in the planar top portion of frame 4. This bushing is provided with a short reduced diameter portion at its lower end that is divided into two semicircular portions which are inserted into the hole in the frame and the lower edges thereof spun over outwardly to secure the bushing rigidly to the frame. The bushing bore 12*a* is provided with an outwardly flared upper end portion 12*b* to afford clearance for pivotal swing of toggle lever 10.

Toggle lever 10 comprises an external handle portion 10*a*, an enlarged partial spherical lower end portion 10*b* for pivoting the toggle lever in the bushing, and a reduced diameter intermediate portion 10*c* allowing sufficient swinging movement of the toggle lever to operate the contacts. A blind hole 10*d* extends up through the enlarged and reduced portions of the toggle lever into the handle portion for retaining a helical compression spring 14 and a plunger 16 for actuating the switch contacts.

This toggle lever is provided with formed pivot means. This means comprises a lateral hole 10*d* through enlarged portion 10*b* of the toggle lever and two trunnions 12*c* and 12*d* punched inwardly from opposite sides of the bushing into opposite ends of hole 10*d* to pivot the toggle lever in the bushing as shown in FIG. 2.

To form this pivot, the bushing is provided with two counter-bores 12*e* and 12*f* through the threads on opposite sides thereof to reduce the thickness of the bushing walls and thereby facilitate forming the trunnions for the pivot. A pair of punches 18*a* and 18*b* are then actuated toward one another as shown in FIG. 1 to form trunnions 12*c* and 12*d* shown in FIG. 2. These trunnions are punched long enough to provide a snug fit with the ends of the pivot hole in the toggle lever so that the toggle lever will have free pivotal movement in its operating plane and will not wobble out of this plane of movement.

Figure 2:
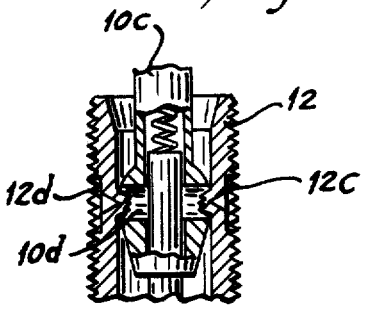
FIG. 2 is a fragmentary cross-sectional view of the pivot structure of FIG. 1 after the forming operation.

It will be apparent that the method of making the pivot in FIGS. 1 and 2 will require forming the lateral hole in the toggle lever, forming the thin sections in the bushing by counter-boring in from opposite sides in alignment, holding the toggle lever within the bushing at the correct angle so that the hole therethrough is in alignment with the counter bores, and then actuating two punches simultaneously to bump the thin sections of the bushing into the toggle lever hole to form the pivoting trunnions.

Figure 3:
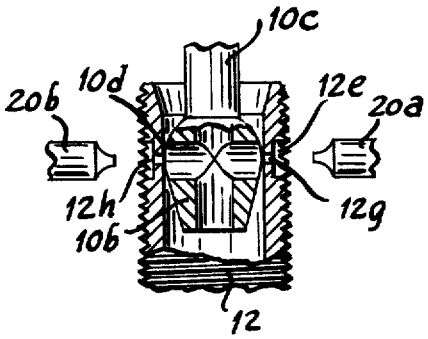
FIG. 3 is an enlarged fragmentary cross-sectional view of a modification of the pivot structure of FIGS. 1 and 2 showing the configuration of the bushing before the forming operation.
Figure 4:
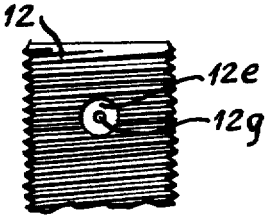
FIG. 4 is a side elevational view of the bushing of FIG. 3 showing the perforation and counter-bore therein.

The modification shown in FIGS. 3 and 4 is similar to the pivot structure shown in FIGS. 1 and 2 with the addition of perforations or small holes 12*g* and 12*h* through the walls of the bushing at the center of the counter bores to facilitate the punching or trunnion forming operation. As shown in FIG. 3, a pair of punches 20*a* and 20*b* having tips the same diameter as these small holes are actuated toward one another. As a result, the punch tips enter holes 12*g* and 12*h* in the sides of the bushing. The outward curvature of these punches leading from the tips thereof then spread the bushing metal surrounding these perforations to form pivotal trunnions within the opposite ends of hole 10*d* in the toggle lever.

Figure 5:
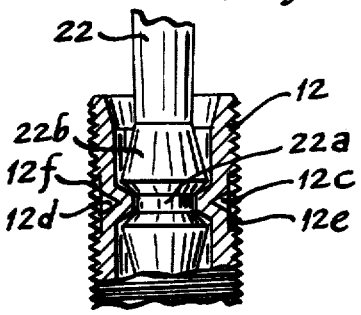
FIG. 5 is an enlarged fragmentary cross-sectional view of a second version of pivot structure completely formed.

The second version of pivotal structure shown in FIG. 5 differs from those shown in FIGS. 1, 2 and 3 in that toggle lever 22 is provided with a groove 22*a* all the way around its enlarged portion 22*b*. While this groove may take various shapes, a beveled groove is shown for exemplary purposes. The bushing 12 shown in FIG. 5 is like that shown in FIGS. 1 and 2 in that counter bored thin sections are bumped into the annular groove in the toggle lever to complete the pivoting structure. It will be apparent that the perforated counter bored sections of FIGS. 3 and 4 could alternatively be used in FIG. 5. In this version shown in FIG. 5, the toggle lever need not be held at any particular angle or at an accurate angle when the bushing sides are punched in since the groove goes laterally all the way around the toggle lever. However, when completed, this pivot structure will confine the toggle lever to pivotal movement in one plane.

FIG. 6 shows a toggle lever 24 incorporating a third version of pivot structure. This version has a pair of blind holes 24*a* and 24*b* extending in from opposite sides of the enlarged, partial spherical portion of the toggle lever, these holes ending short of the spring-biased plunger retaining hole 24*c*. This version of toggle lever is usable with either the counter bored type of bushing of FIGS. 1 and 2 or the counter bored and perforated type of bushing of FIGS. 3 and 4.

Figure 7:
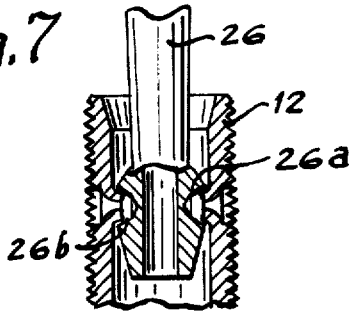
FIG. 7 is an enlarged cross-sectional view of a modification of the pivot structure of FIG. 6 along with the bushing of FIGS. 3 and 4 after the forming operation.

FIG. 7 shows a modification of the pivot structure of FIG. 6, differing from the latter in that the two blind holes in opposite sides of the enlarged portion of toggle lever 26 are additionally counter-sunk substantially to the bottom thereof to provide chamfered or beveled blind holes 26*a* and 26*b*. The bushing 12 shown in FIG. 7 is like the bushing shown in FIGS. 3 and 4 having counter bored and perforated sections that are punched in to form trunnions for pivotally supporting the toggle lever, these trunnions taking a shape complementary to the beveled blind holes in the toggle lever as shown in FIG. 7. It will be apparent that this toggle lever 26 shown in FIG. 7 could alternatively be used with the counter bored but unperforated type of bushing shown in FIGS. 1 and 2.

While the apparatus hereinbefore described is effectively adapted to fulfill the objects stated, it is to be understood that the invention is not intended to be confined to the particular preferred embodiments of formed pivot for toggle lever and method of making disclosed, inasmuch as they are susceptible of various modifications without departing from the scope of the appended claims.

We claim:

1. In an electric switch or the like having a mounting bushing and a toggle lever, the improvement comprising pivot means mounting said toggle lever in said bushing to allow limited pivotal movement of said toggle lever in one plane while preventing said toggle lever from wobbling out of said plane as well as from being withdrawn from the bushing bore, said pivot means comprising:

an enlarged portion on said toggle lever within said bushing;

trunnion-receiving recess means in diametrically opposite sides of said enlarged portion of said toggle lever;

and rigid trunnions formed by inwardly offsetting diametrically opposite portions of the side walls of said bushing so as to extend into said recess means and pivot said toggle lever for limited movement in said one plane.

2. The improvement according to claim 1, wherein: said opposite portions of the side walls of said bushing are provided with external counter bores to provide thinner sections to facilitate forming of said trunnions.

3. The improvement according to claim 2, wherein: said thinner sections are each provided with a central perforation to initially receive the tips of punches when said trunnions are formed.

4. The improvement according to claim 1, wherein: said recess means for said trunnions are provided by a hole extending through said enlarged portion of said toggle lever.

5. The improvement according to claim 1, wherein: said recess means for said trunnions are provided by a pair of blind holes extending into said enlarged portion of said toggle lever on a common axis.

6. The improvement according to claim 5, wherein: said blind holes are counter-sunk.

7. The improvement according to claim 1, wherein: said recess means are provided by an annular groove around said enlarged portion of said toggle lever.

8. The improvement according to claim 7, wherein: said annular groove is beveled.

9. The method of providing pivot means for mounting a toggle lever in the mounting bushing of an electric switch or the like to allow limited pivotal movement of the toggle lever in one plane while preventing it from wobbling out of said plane as well as from being withdrawn from the bushing bore comprising:

forming trunnion-receiving recesses in an enlarged portion of the toggle lever within the bushing:

forming side wall portions of said bushing of suitable thickness to provide trunnions when punched inwardly into said recesses;

and punching said side wall portions into said recesses to form rigid trunnions extending into said recesses to pivotally support said toggle lever in said bushing.

10. The method according to claim 9 wherein:

said forming of said trunnion-receiving recesses comprises making a single hole through said enlarged portion of said toggle lever the opposite ends of which provide said recesses.

11. The method according to claim 9, wherein:

said forming of said trunnion-receiving recesses comprises making blind holes in said enlarged portion of said toggle lever that extend inwardly from opposite sides thereof.

12. The method according to claim 11, wherein:

said forming of said trunnion-receiving recesses also comprises counter-sinking said blind holes.

13. The method according to claim 9, wherein:

said forming of said trunnion-receiving recesses comprises making a groove around said enlarged portion of said toggle lever.

14. The method according to claim 13, wherein:

said making of said groove comprises providing said groove with beveled sides.

15. The method according to claim 9, wherein:

said forming of side wall portions on said bushing comprises reducing the thickness of said side wall portions from the outside of said bushing by counter-boring.

16. The method according to claim 15, wherein:

said forming of side wall portions on said bushing further comprises providing a small perforation at the center of the reduced thickness side wall portions of suitable size to receive the tip of a punch preparatory to forming said trunnions.

* * * * *